US011059551B1

(12) United States Patent
Perkins

(10) Patent No.: US 11,059,551 B1
(45) Date of Patent: Jul. 13, 2021

(54) UNDERWATER POSITION MARKING DEVICE AND SYSTEM

(71) Applicant: Jeffrey Keith Perkins, Collierville, TN (US)

(72) Inventor: Jeffrey Keith Perkins, Collierville, TN (US)

( * ) Notice: Subject to any disclaimer, the term of this patent is extended or adjusted under 35 U.S.C. 154(b) by 0 days.

(21) Appl. No.: 16/590,453

(22) Filed: Oct. 2, 2019

Related U.S. Application Data

(60) Provisional application No. 62/743,375, filed on Oct. 9, 2018.

(51) Int. Cl.
*B63C 11/26* (2006.01)

(52) U.S. Cl.
CPC ..... *B63C 11/26* (2013.01)

(58) Field of Classification Search
CPC .. B63C 11/26; B63C 7/26; B63C 9/20; B63B 45/00
USPC ..... 441/23, 32
See application file for complete search history.

(56) References Cited

U.S. PATENT DOCUMENTS

| | | | | | |
|---|---|---|---|---|---|
| 2,968,819 | A * | 1/1961 | Jenson | B63B 22/10 | 441/8 |
| 3,049,733 | A * | 8/1962 | Mennenga | A01K 97/24 | 441/8 |
| 4,126,907 | A * | 11/1978 | Fish | B63B 22/10 | 43/25 |
| 5,096,448 | A | 3/1992 | Gray | | |
| 5,219,245 | A * | 6/1993 | Chin-Yee | B63B 22/06 | 405/188 |
| 5,403,219 | A * | 4/1995 | Ryan | B63B 22/00 | 116/173 |
| 6,652,339 | B1 | 11/2003 | Carmichael | | |
| 9,776,690 | B1 | 10/2017 | Sledzinski | | |

* cited by examiner

*Primary Examiner* — Anthony D Wiest
(74) *Attorney, Agent, or Firm* — Hamre, Schumann, Mueller & Larson, P.C.

(57) ABSTRACT

An underwater diving marker is disclosed which has a tube with at least one removable end. A strap element extends between the removable end and the housing and is folding or otherwise compressed to fit within the housing. The end cap has a positive buoyancy so it will float when separated from the housing even with being attached to the strap. The housing includes a weight element which insures that the housing has a negative buoyancy when separated from the end cap. The user removes the end cap and allows it to float up pulling the strap/tether, while the housing sinks to the sea floor, thereby providing an indicator flag to divers.

19 Claims, 28 Drawing Sheets

UNDERWATER POSITION MARKING DEVICE AND SYSTEM

CROSS-REFERENCE TO RELATED APPLICATION

This application claims priority and incorporates by reference in its entirety the disclosure of U.S. provisional patent application No. 62/743,375 filed 9 Oct. 2018.

BACKGROUND OF THE DISCLOSURE

Field of the Disclosure

The present disclosure is directed to an underwater position marking device and system which is used primarily to indicate a location during an underwater dive so that the position can be found again.

Description of the Related Art

A dive marker is a device which allows an underwater diver to tag a location and then find the marker later to return to that location at another time.

Prior art dive markers such as in U.S. Pat. No. 6,652,339 to Carmichael, involves a post which can be attached to the sea floor and which can be inflated to remain upright. A similar item is shown in U.S. Pat. No. 5,096,448 to Gray et. al. which is likewise inflatable. A further alternative is shown in U.S. Pat. No. 9,776,690 to Sledzinski et. al.

It is noted that sub-sea markers differ from buoys in that the sub-sea devices do not need to reach the water's surface.

The problem with prior art devices, is that they are bulky, difficult for a diver to transport and difficult to erect. Furthermore, many get their buoyancy from air provided in the diver's air tank, thus requiring the diver to provide an air supply to deploy. The present disclosure overcomes these disadvantages.

BRIEF SUMMARY

The disclosure encompasses many embodiments. One such embodiment is detailed below in summary fashion. Please understand that this summary does not encompass the entire disclosure but is provided to assist the reader in reviewing the entire disclosure and claims which also constitute part of the disclosure.

There is disclosed a vertical dive position marker having any or all of the following elements: a housing having an inner peripheral wall and defining a space within said wall; a first end cap sized to be fitted to said housing and being replaceably removable therefrom said first end cap being separately water buoyant when apart from said housing, so that when released it will float; said first end cap having a fixation point; an elongated web strap member having first and second ends, said first end being attached to said fixation point and said second end being attached to said housing; said web strap member being folded and fitted within said housing when said first cap is fitted on said housing and extendable when said first cap is separated from said housing and allowed to float upwardly; said housing including a weight of sufficient mass that said marker has negative buoyancy; so that when said first end cap is separated from said housing, it will float upwardly, thereby extending the web strap vertically and while the housing sinks.

Also disclosed is a reusable vertical underwater location marker having any or all of the following elements: a housing having an inner peripheral wall and defining a space within said wall and first and second ends; a first end cap sized to be fitted to said housing at said first end and being replaceably removable therefrom said first end cap including a float element so that said first end cap has positive buoyancy when separated from said housing, so that when released therefrom it will float; said first end cap including a first inner cap; a second end cap sized to be fitted to said housing at said second end and having a second inner cap; said housing and end caps together define an initially water tight enclosure with overall positive buoyancy; an elongated web strap member having first and second ends, said first end being attached to said first inner cap and said second end being attached to said second inner cap; said web strap member being initially folded and fitted within said housing defined space when said first end cap is fitted on said housing and said web strap being extendable when said first cap is separated from said housing and allowed to float upwardly; said housing including a weight of sufficient mass that said marker has negative buoyancy; so that when said first end cap is separated from said housing, it will float upwardly, thereby extending the web strap vertically and while the housing sinks.

The marker may also include where the first inner cap surrounds at least in part, said float and engages with said first end cap to immobilize said float between said first end cap and said first inner cap.

The marker may also include where the second inner cap surrounds at least in part, said weight and engages with said second end cap to immobilize said weight between said second end cap and said second inner cap.

Also disclosed is where the first cap includes flexible bias fingers and wherein said housing includes a plurality of apertures positioned to engage said fingers when said first cap is fitted to said housing.

Also disclosed is where the first inner cap includes flexible fingers and wherein said housing includes an inner ridge positioned to engage said fingers when said first cap is fitted to said housing, and further including a floatation element sized to be received within a spaced defined by the first inner cap and said first end cap when the two are brought together with the floatation element therein.

Also disclosed is where the floatation element is interchangeable to provide interchangeable levels of buoyancy as needed based on the weight of the device.

Also disclosed is where the weight element is interchangeable to provide interchangeable levels of buoyancy as needed based on the weight of the device.

Also disclosed is where the web strap member has first and second ends and wherein each end includes a flange, and wherein said flanges are attached to said first and second inner caps respectively.

Also disclosed is where the first illumination element which is activated when first end cap is separated from the housing.

Also disclosed is where the second illumination element is attached to said housing.

Also disclosed is where the first illumination element which is integral to said web strap element and provides points of illumination at least periodically along a portion of the length thereof.

Also disclosed is where the element includes a chemical illuminant which is activated when said web strap element is removed from the housing.

Also disclosed is where the element includes an electrical illuminating element which is activated when said web strap element is removed from the housing.

Also disclosed is a method of constructing a dive position marker having a housing tube having first and second ends, first and second outer end caps, first and second inner end caps, a web strap element, first and second ends attachable to said tube ends, a weight element and a floatation element, comprising any or all of the steps of in any order:

a. configuring the inner caps to fit into the outer cap thereby defining a confining space therebetween;
b. affixing a flotation element within the space defined by the attachment of said first outer end cap to said first inner end cap;
c. affixing a weight element within the space defined by the attachment of said second outer end cap to said second inner end cap;
d. affixing the first end of said strap element to said first end cap;
e. affixing the second end of the strap element to said second end cap;
f. folding the strap element so that it can fit entirely within said housing when said end caps are emplaced on the housing; and
g. inserting said folded strap within said housing.

Also disclosed is a method including selecting the weight element to have sufficient mass to insure that the housing will have negative buoyancy. Selecting the floatation element to have sufficient positive buoyancy to float the first end cap when separated from the housing with the strap element connected between the housing and first end cap.

Many other features and combinations are disclosed and claimed.

DETAILED DESCRIPTION

Figure 1:
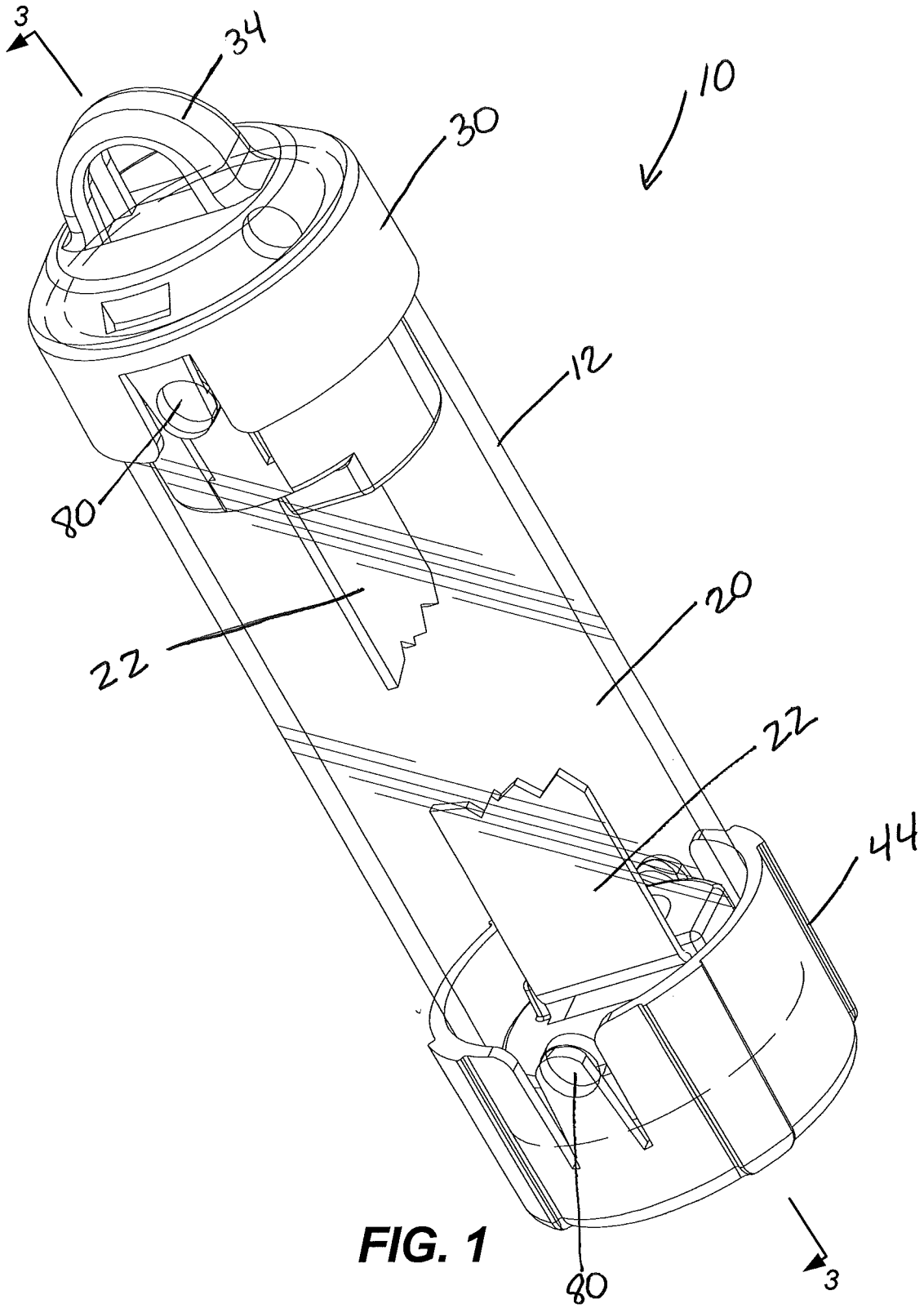
FIG. 1 is a perspective view of one embodiment of a dive marker.

A diver marker 10 is shown in FIG. 1. It has a central housing 12 which in this case is tubular, but can be multi-faceted (f ex. an octagon), oval or any other shape capable of having a removable cap and defining a holding space 20 therein.

The housing in the preferred case is tubular and transparent or translucent so that it is possible to see the tether/web strap element 22 (shown only with stub ends in FIG. 1. In practice, preferably the strap is a continuous flexible web which can be stuffed/folded into space 20 and unfurled when the top cap 30 is removed. The strap could also be as simple as a string, rope, wire or filament, but it will be referred to as a web strap, meaning all forms. The web strap 22 allows the top cap 30 to be detached and allowed to float without floating away untethered.

Top end cap 30 optionally includes a belt loop 34 for attaching to a diver's belt or other hookable location. The marker 10 can be water tight until opened; allowing the unit to float to the surface if it becomes accidentally detached.

Tube 12 also may have a removable lower cap 44 though the bottom of the tube may also suffice.

Figure 2:
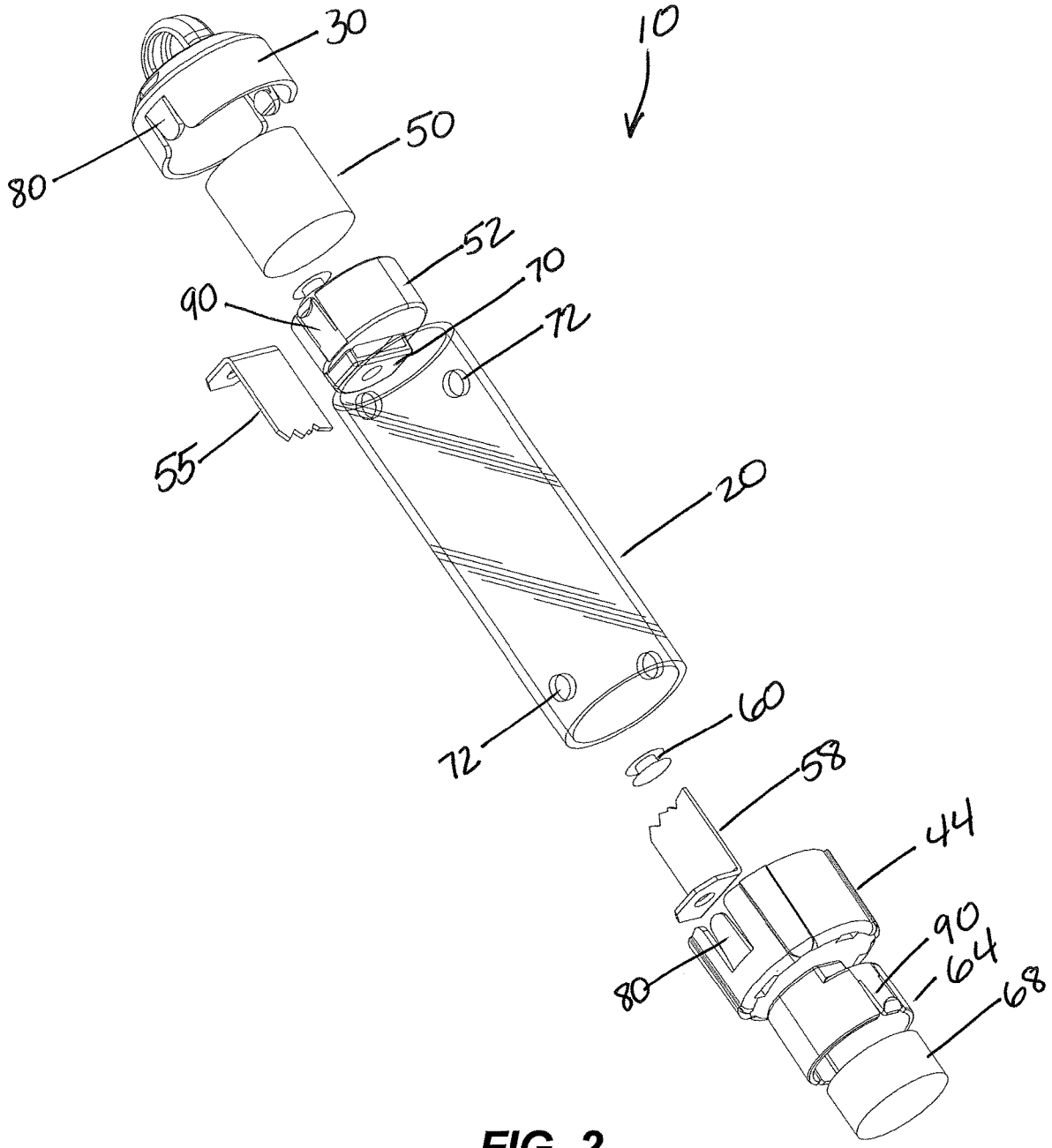
FIG. 2 is a view like FIG. 1 but exploded.

FIGS. 2 and 2A show an exploded view where the top end cap 30 receives an inner end cap 52 which defines a confined space where a float 50 may be inserted and retained. The float size and density is to be selected to give the top end cap positive buoyancy (float) so that it will be able to draw the strap 22 upwardly thus creating a tethered floating marker consisting of the tube 20 and perhaps lower end cap 44 which sink to the sea floor and upper cap 30 rising to unfurl the strap 22 to its full extent. Top end cap 24 may also include a light indicator, such as a flashing light, or a sound indicator, such as a ping generator, to help find the marker. The tube may also include such light and sound markers.

Upper and lower end caps 30/44 preferably include flexible finger elements 80 with inward projections sized to engage holds 72 in the tube.

In the lower cap 44 (or if the tube has no lower cap), a ballast or weight 68 is affixed. In this embodiment with a lower cap, an inner cap 64, like inner cap 52, creates a confined space where weight 68 is inserted. The weight is selected to create negative buoyancy, causing the tube to sink.

Figure 3:
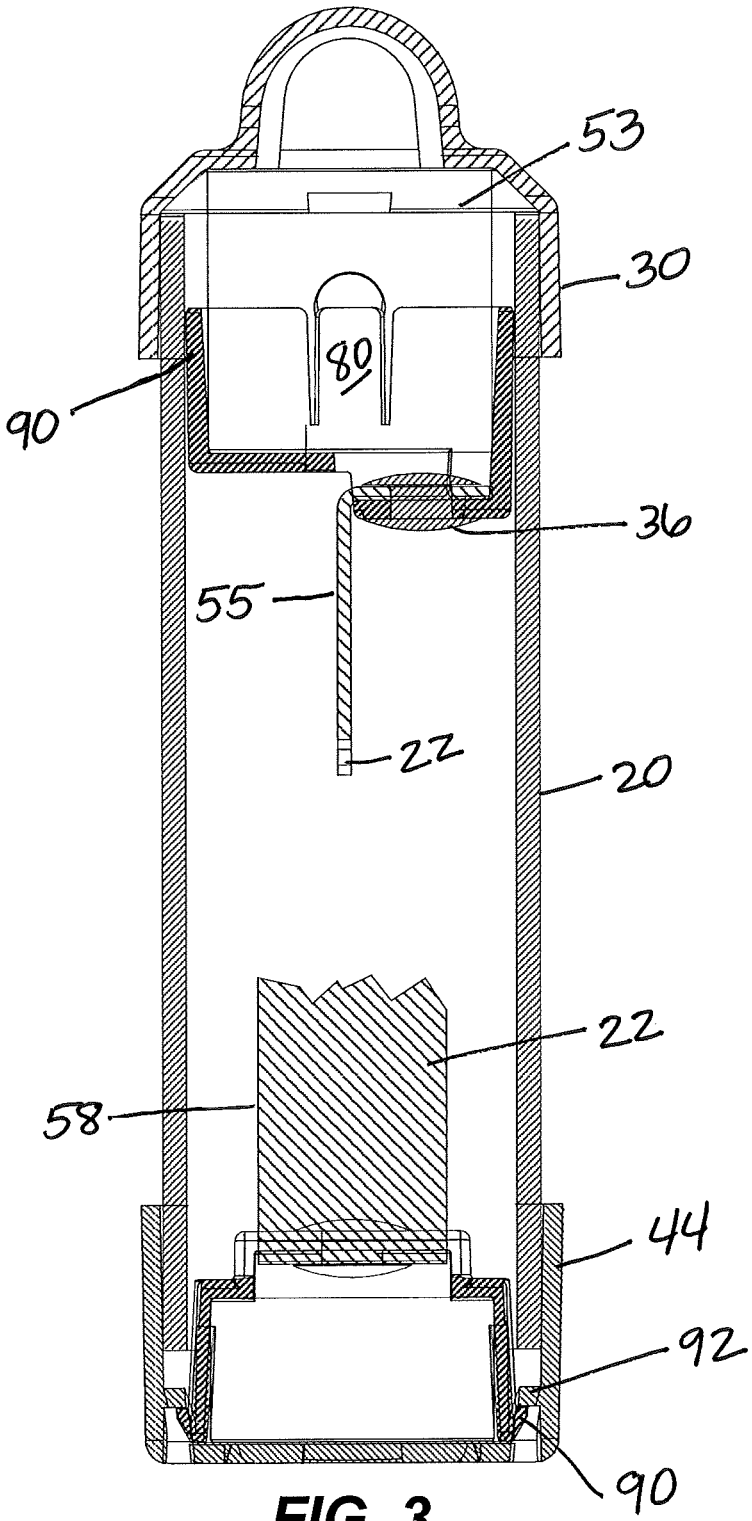
FIG. 3 is front plan view taken along lines 3-3 of FIG. 1.
Figure 4:
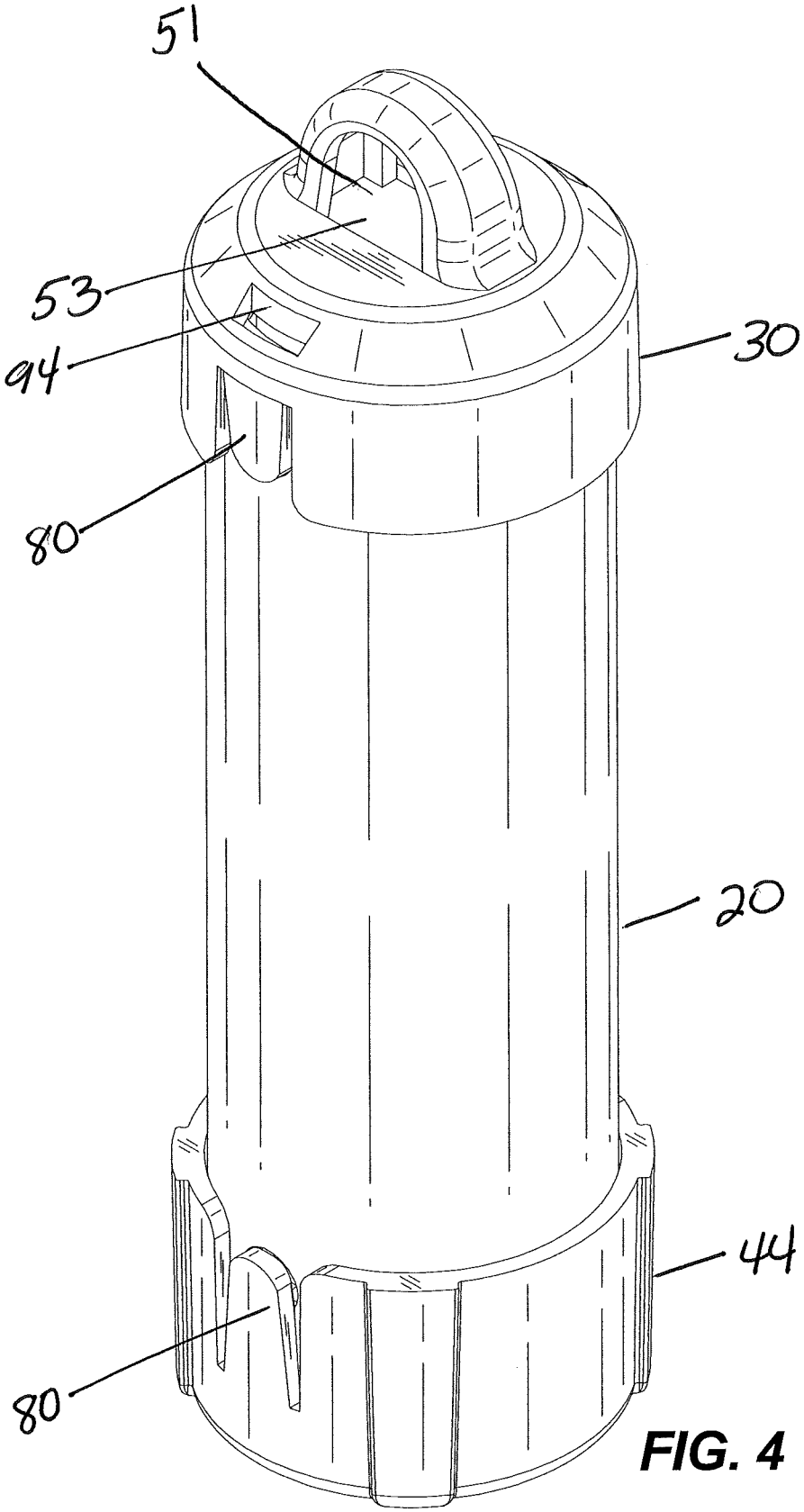
FIG. 4 is a top perspective view.
Figure 5:
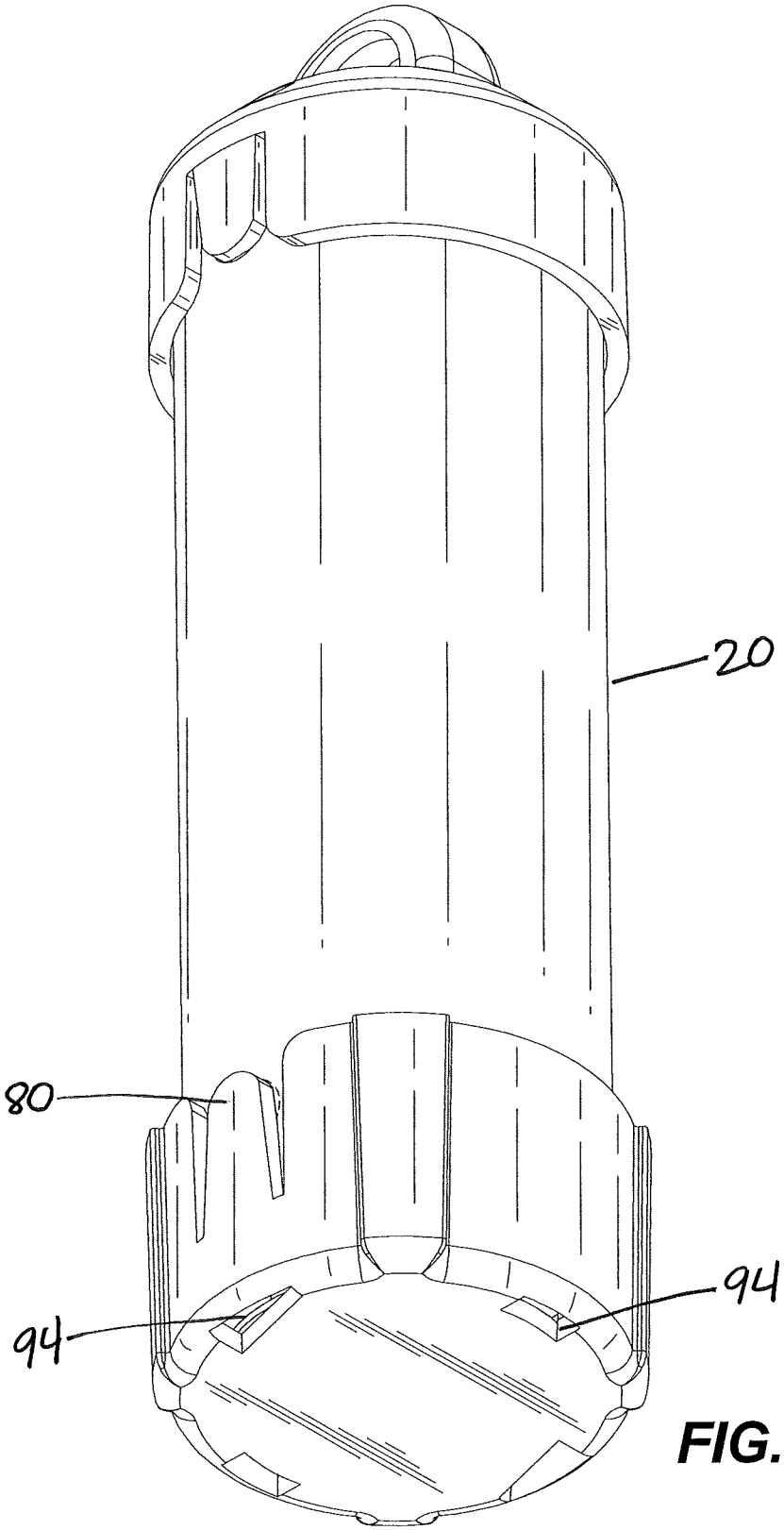
FIG. 5 is a bottom perspective view.
Figure 6:
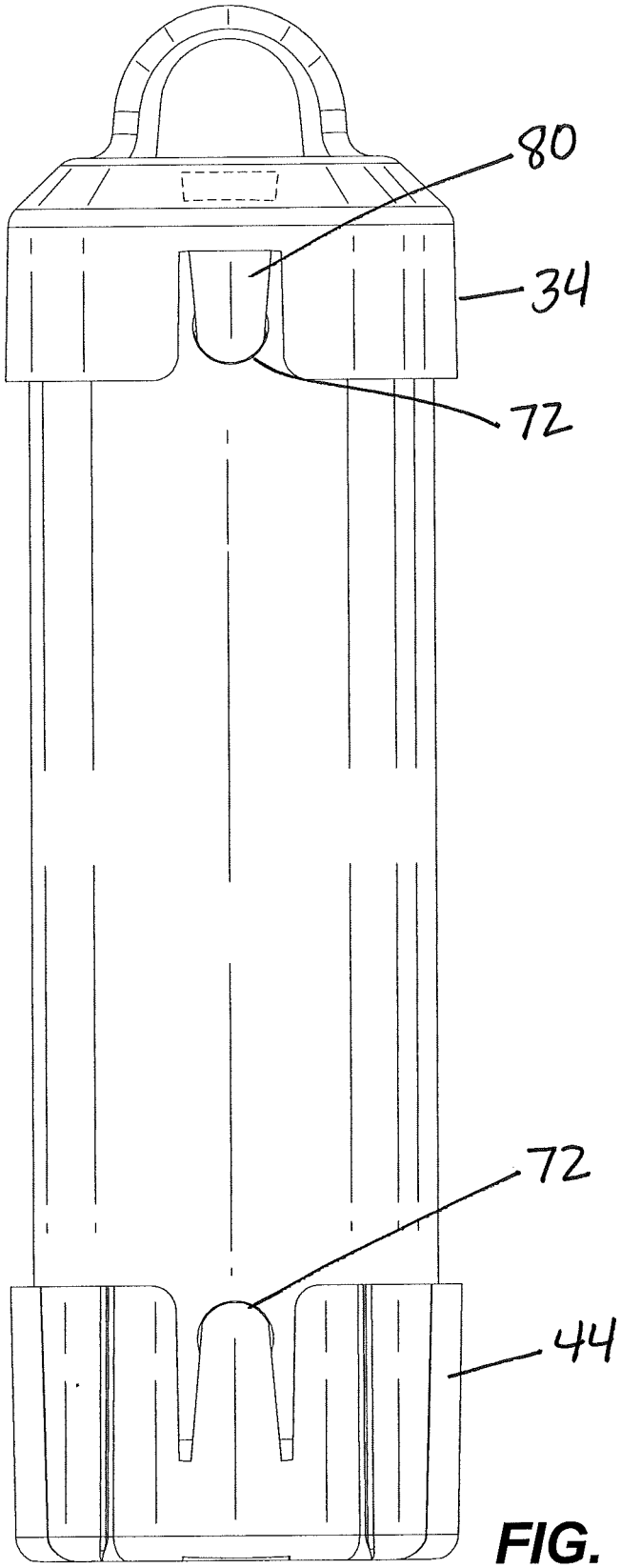
FIG. 6 is a front plan view.
Figure 7:
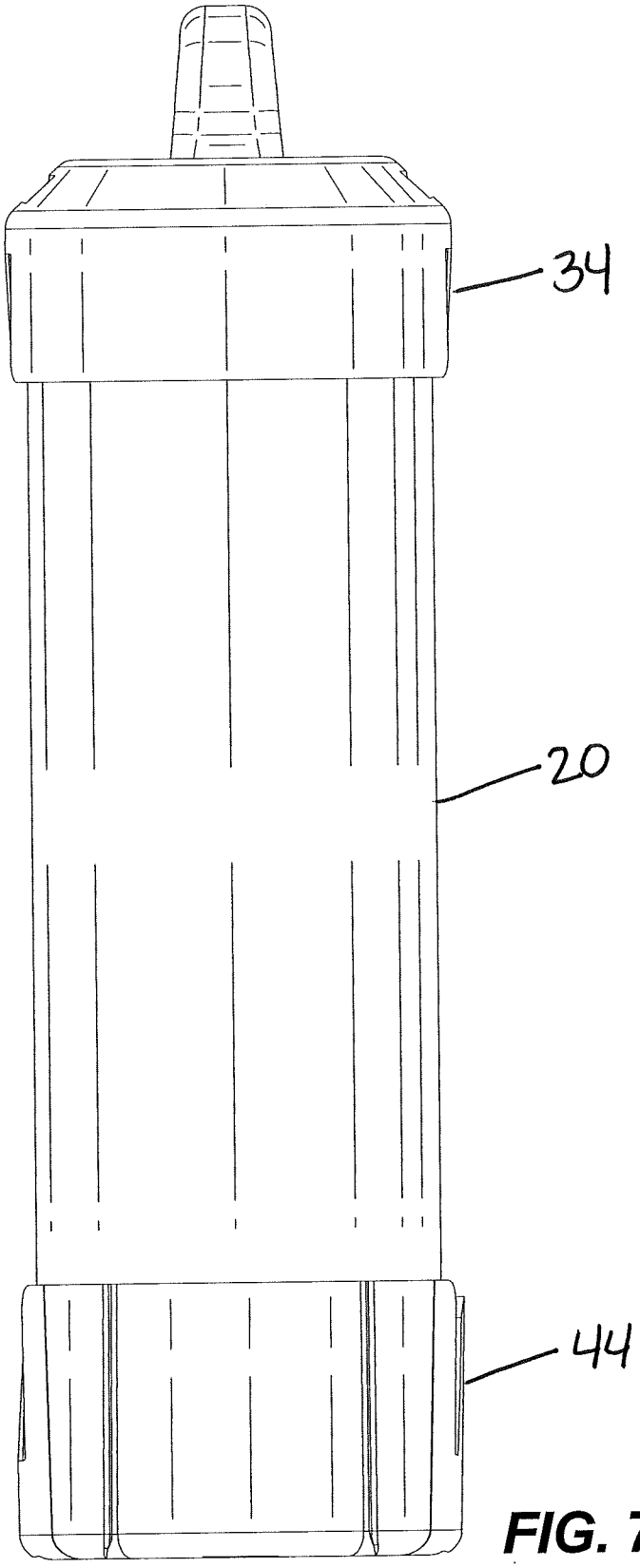
FIG. 7 is a side plan view.
Figure 8:
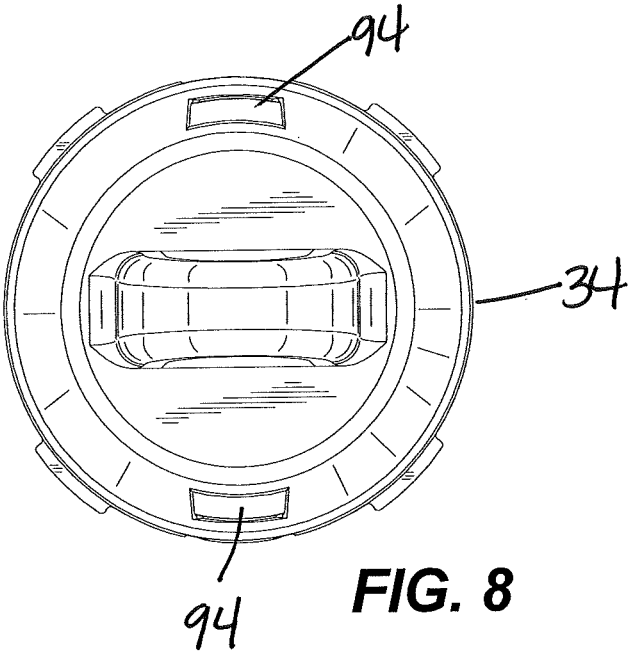
FIG. 8 is a top plan view.
Figure 9:
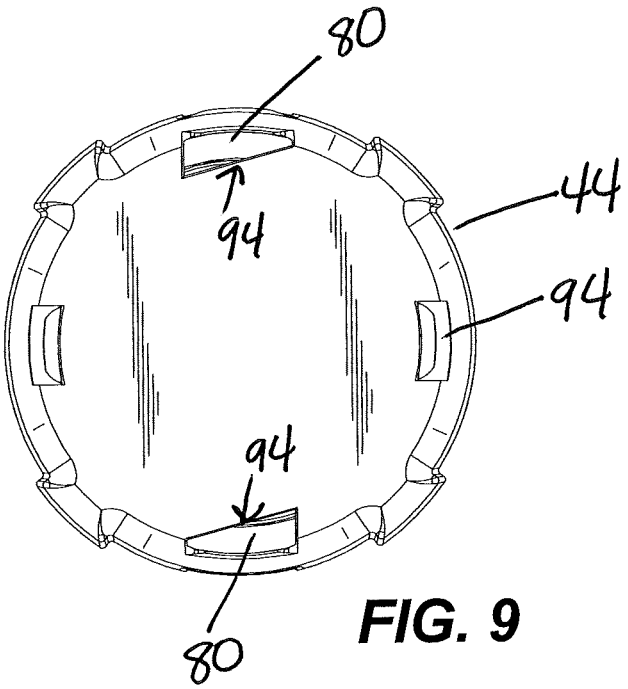
FIG. 9 is a bottom plan view.
Figure 10:
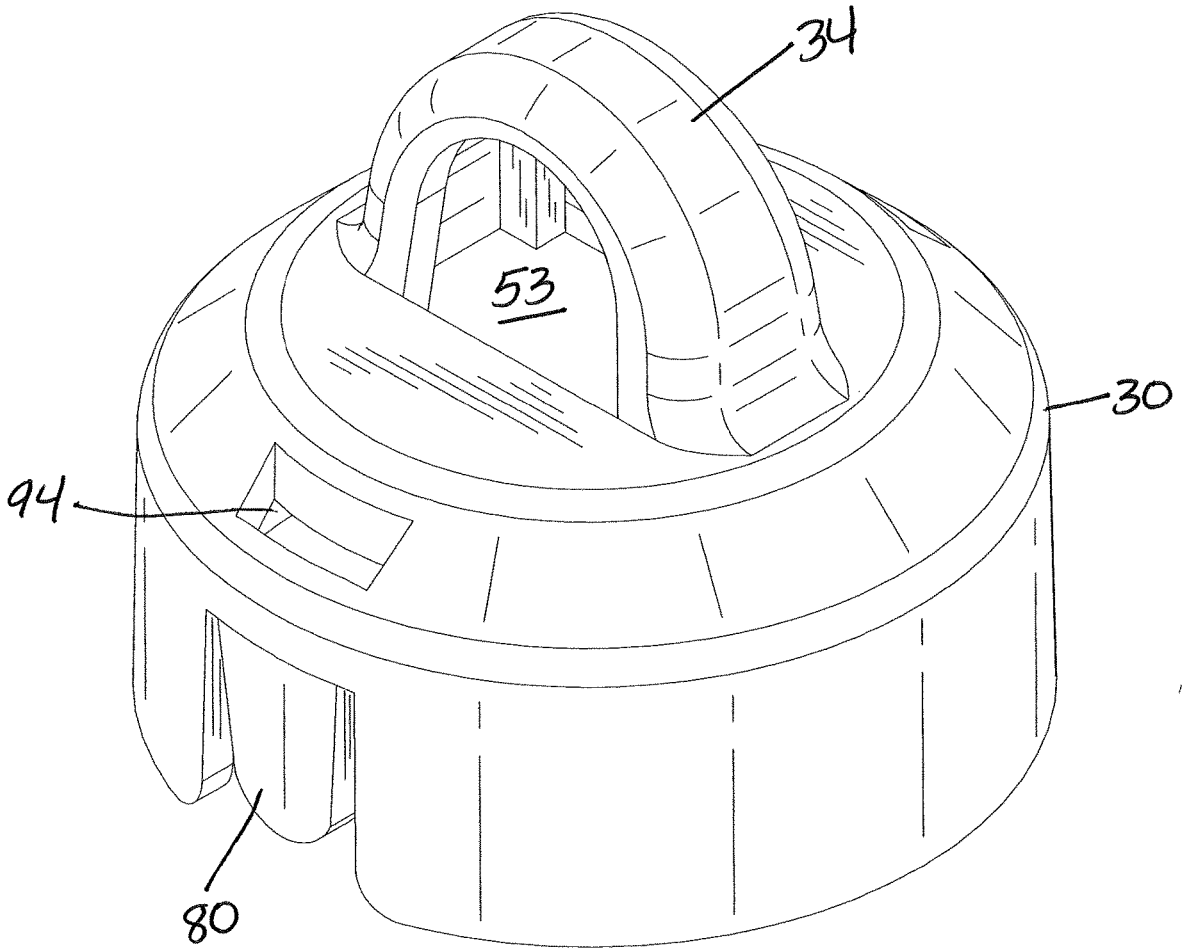
FIG. 10 is a perspective view of the top end cap.
Figure 11:
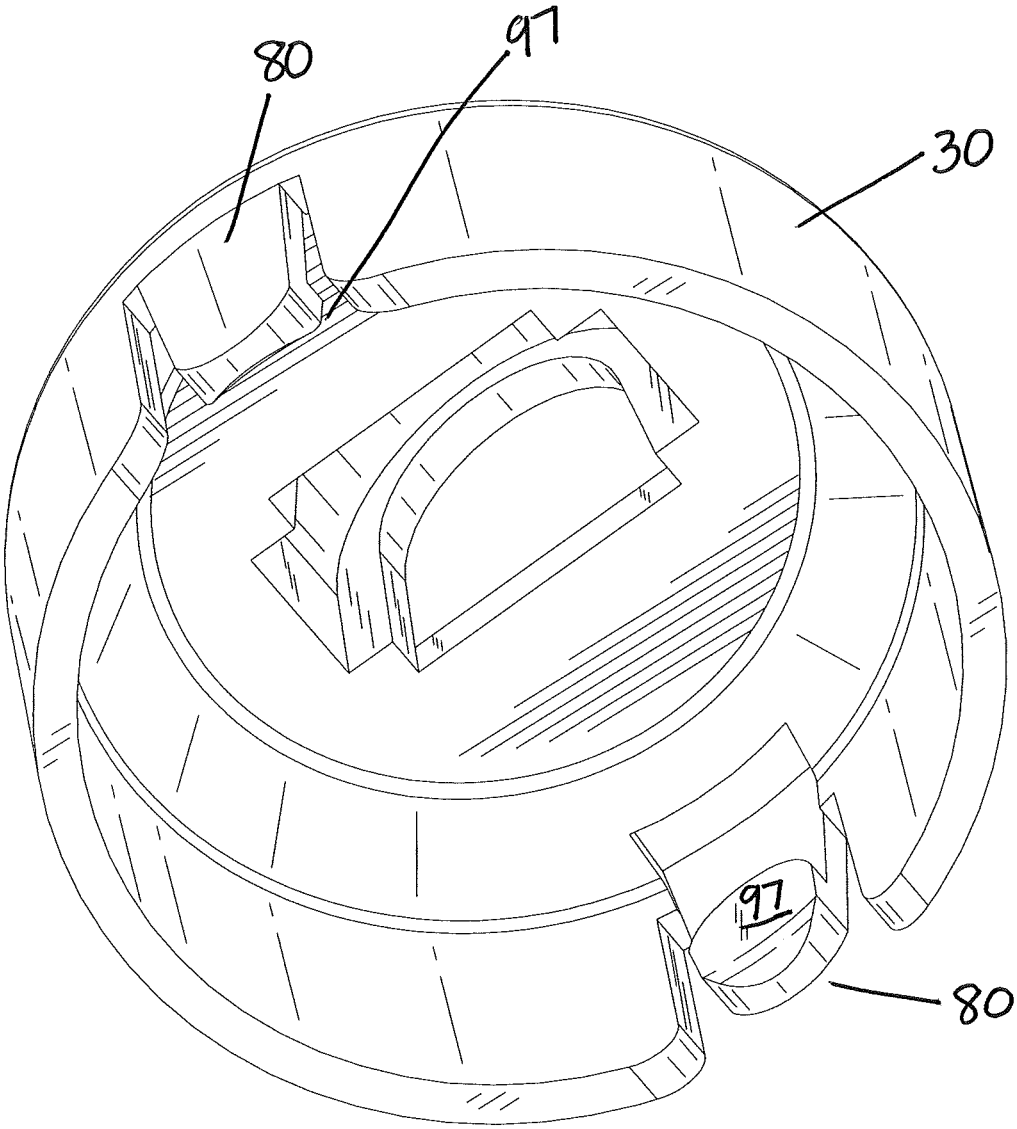
FIG. 11 is a bottom perspective view of the top end cap.
Figure 12:
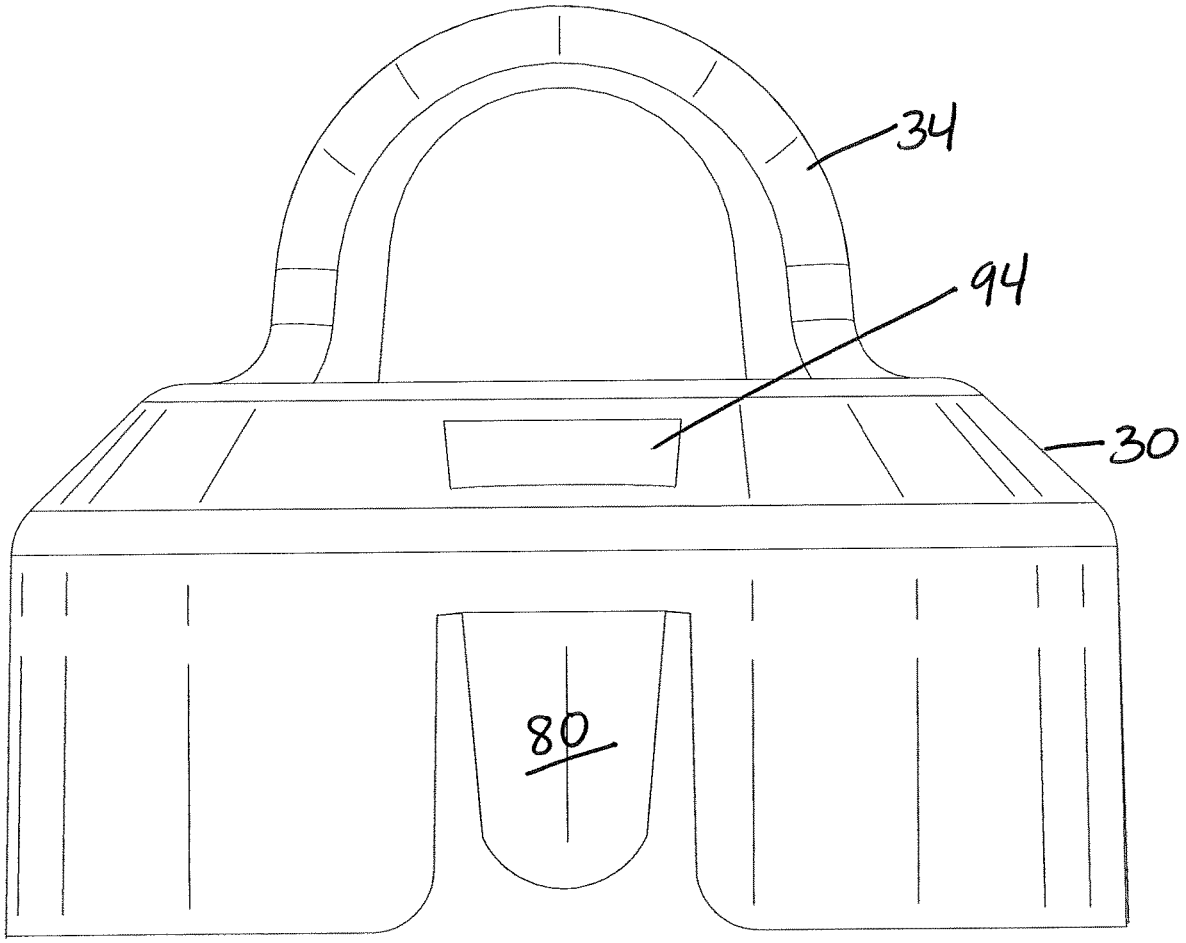
FIG. 12 is a side plan view of the top end cap.
Figure 13:
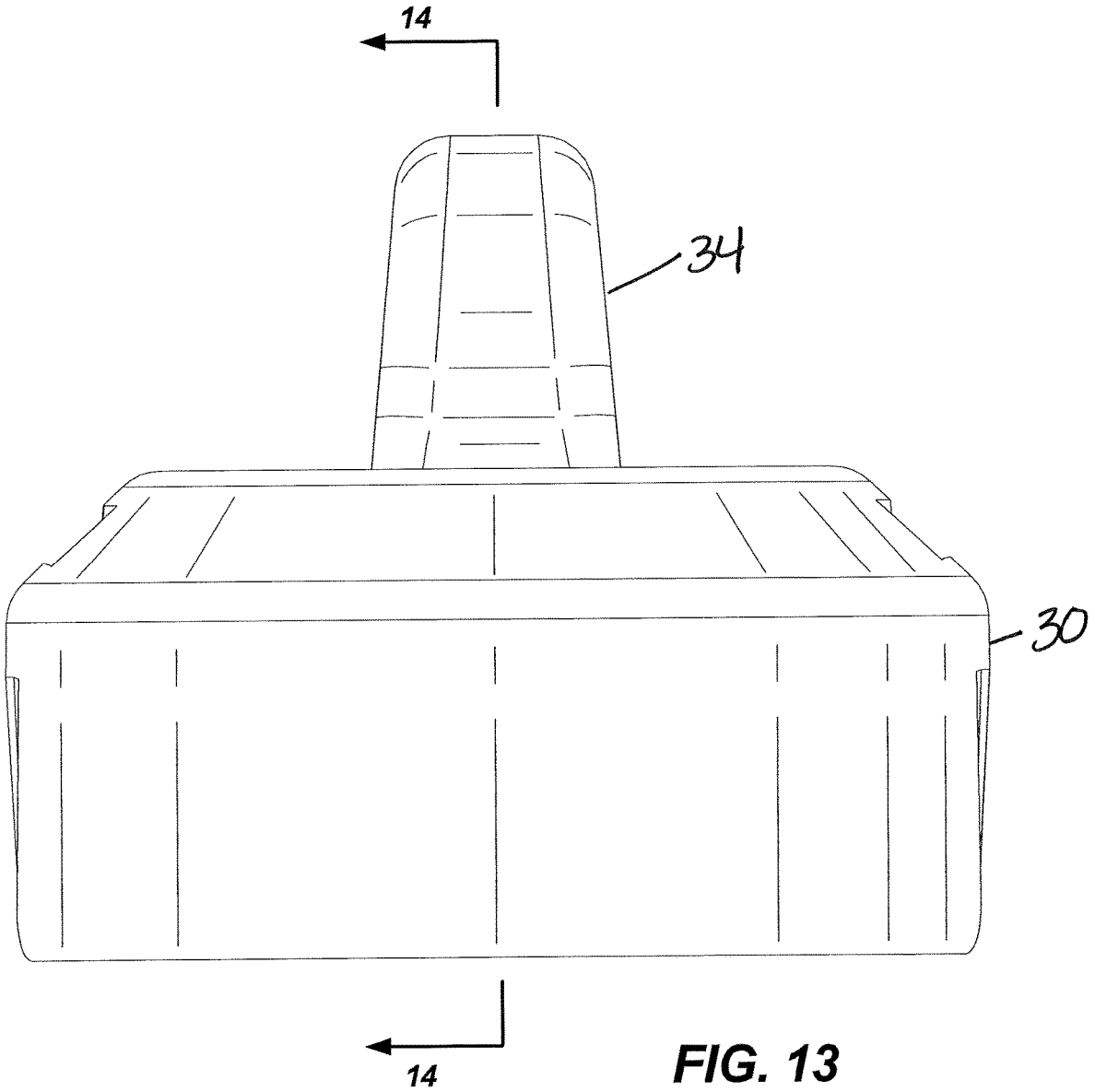
FIG. 13 is a view like FIG. 12 rotated 90 degrees.
Figure 14:
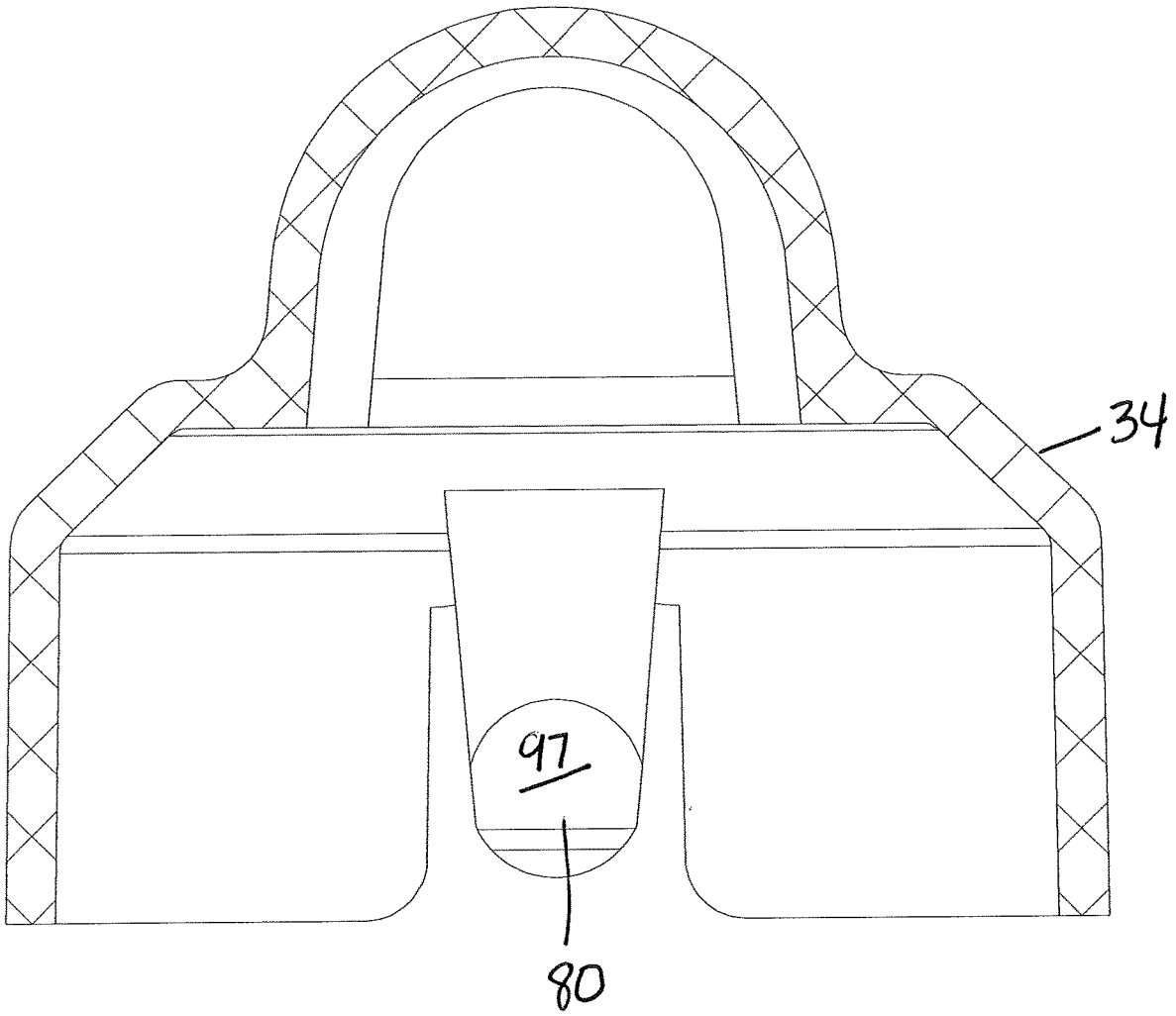
FIG. 14 is a sectional view of FIG. 13 taken along lines 14-14 of FIG. 13.
Figure 15:
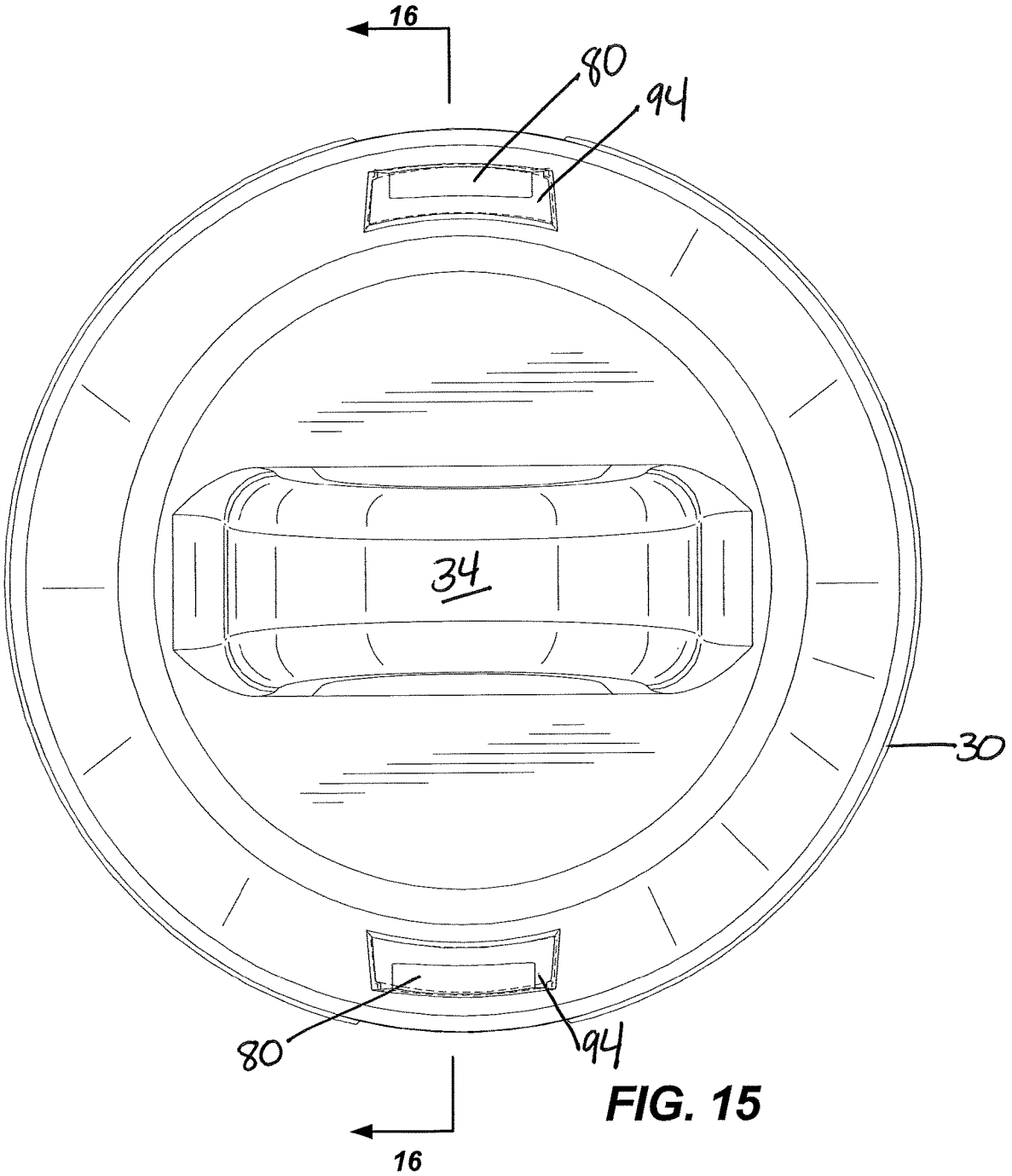
FIG. 15 is a top plan view of the top cap.
Figure 16:
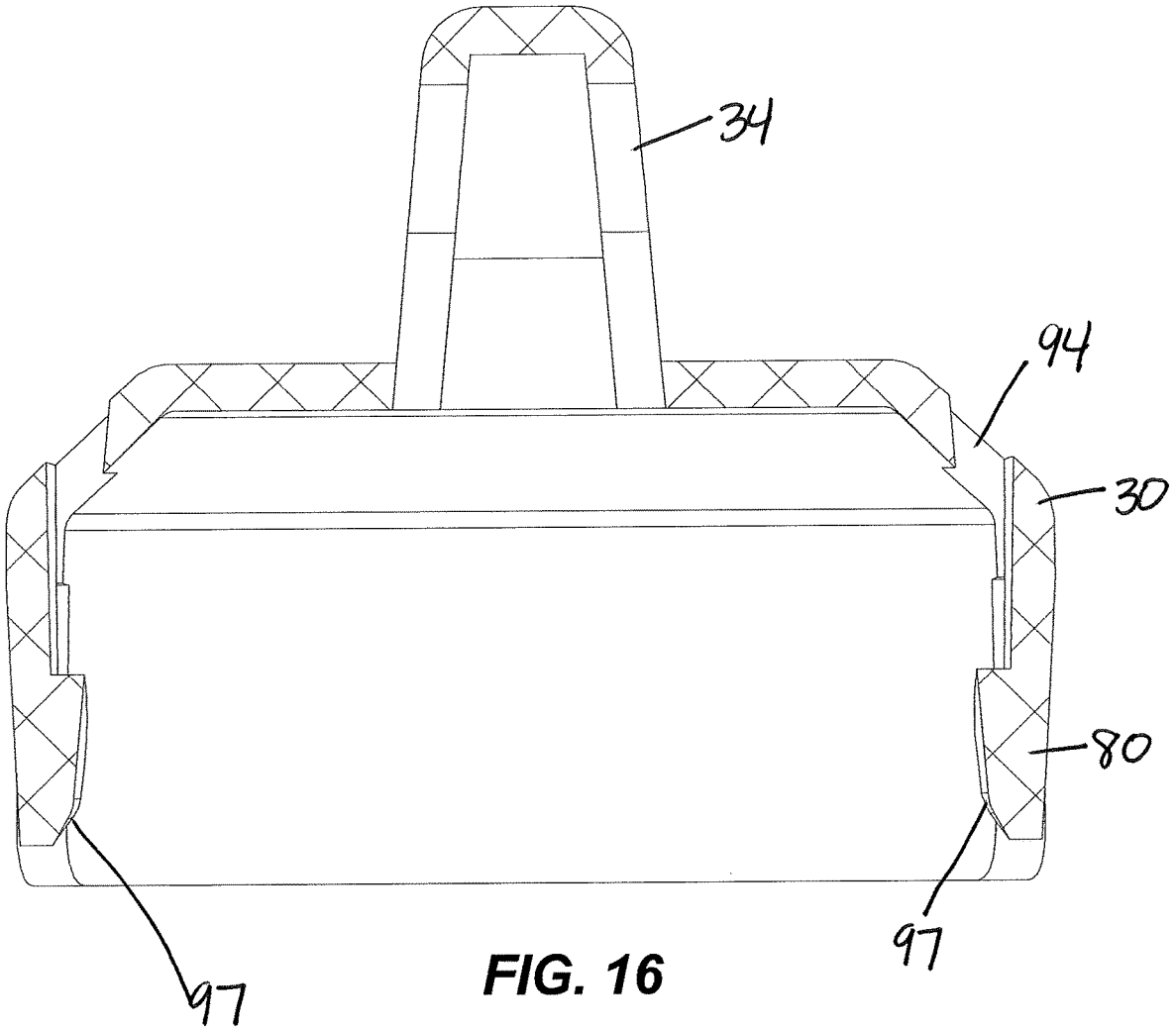
FIG. 16 is a side sectional view taken along lines 16-16 of FIG. 15.
Figure 17:
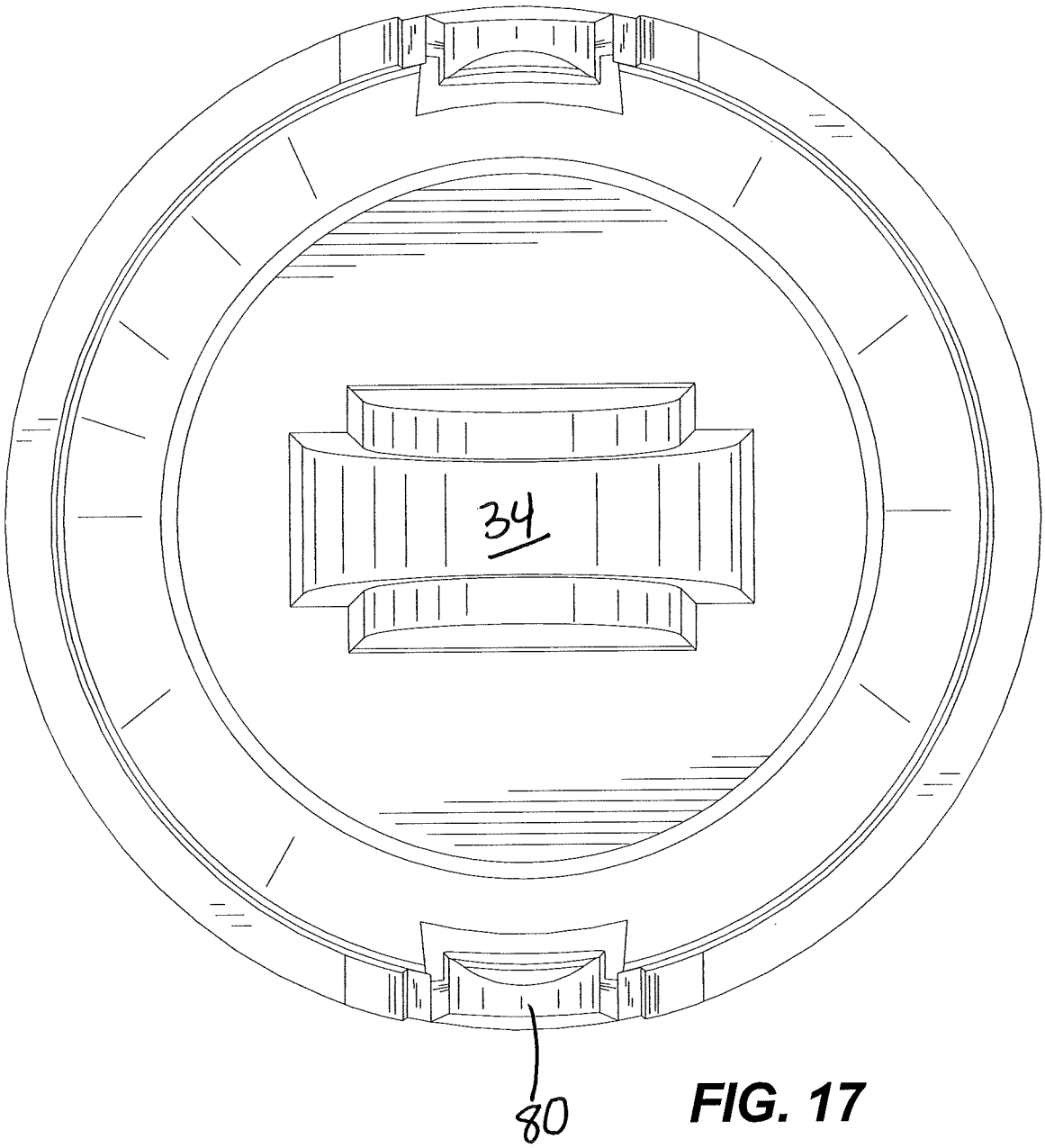
FIG. 17 is a top plan view of the bottom cap.
Figure 18:
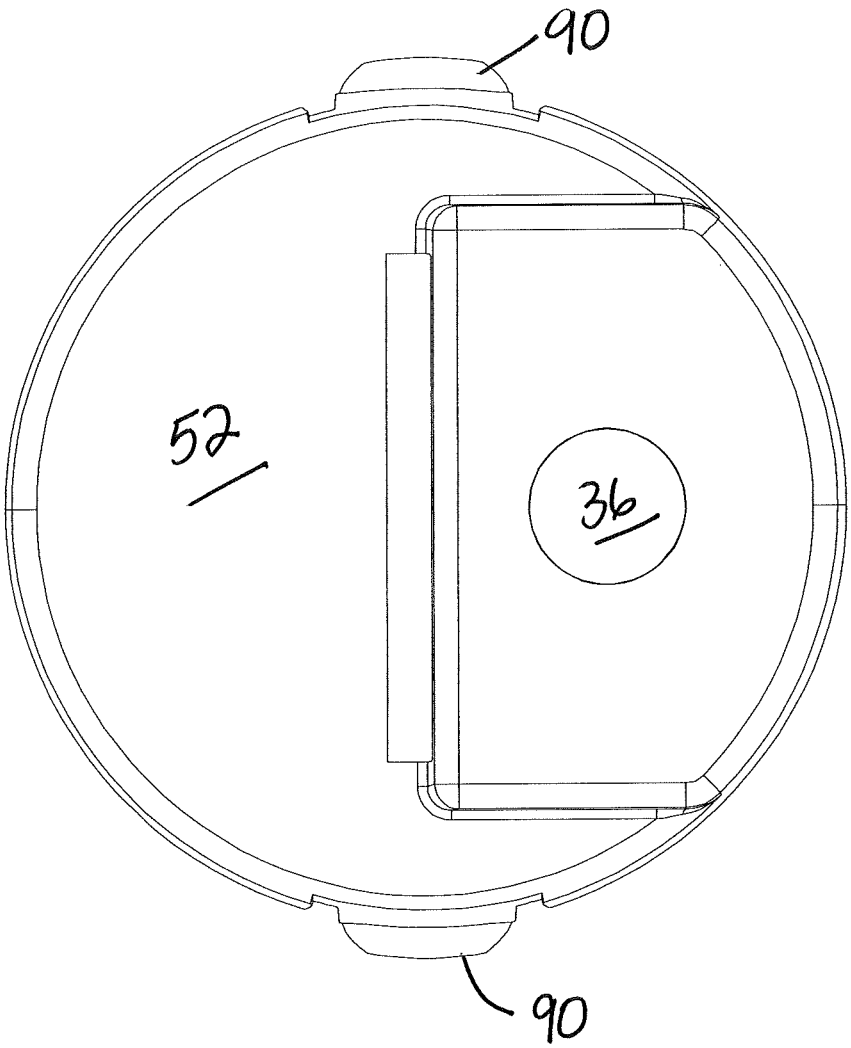
FIG. 18 is a plan view of inside the tubular housing toward the top cap.
Figure 19:
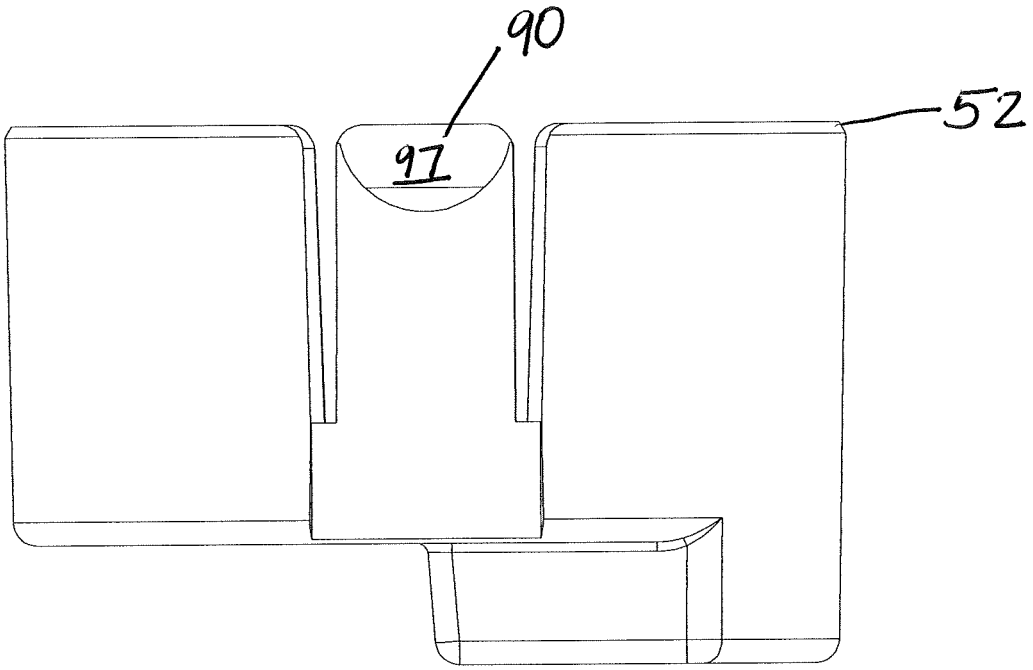
FIG. 19 is a close up view of part of an end cap showing the engagement finger.
Figure 20:
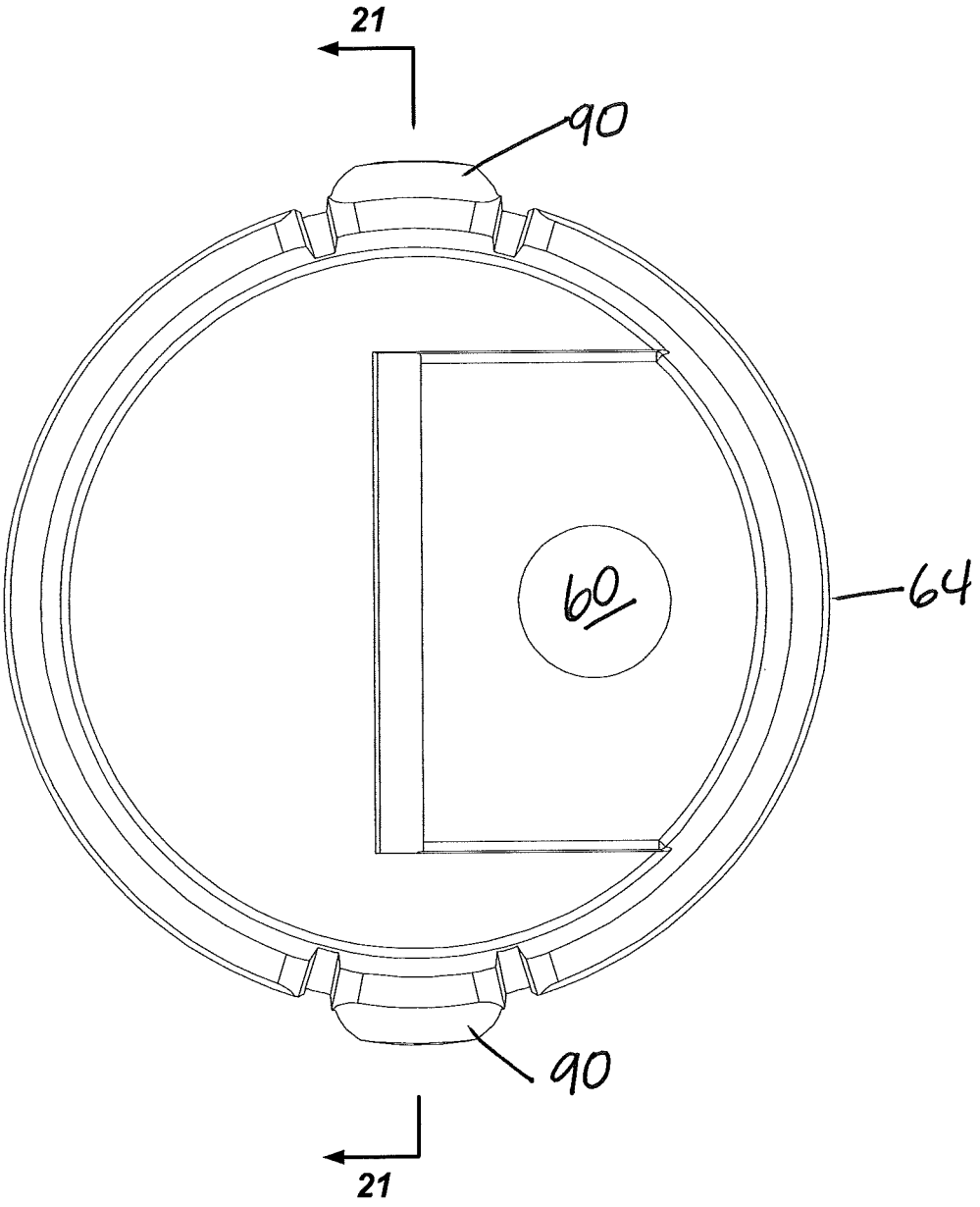
FIG. 20 is a view like FIG. 18 but of the lower end cap.
Figure 21:
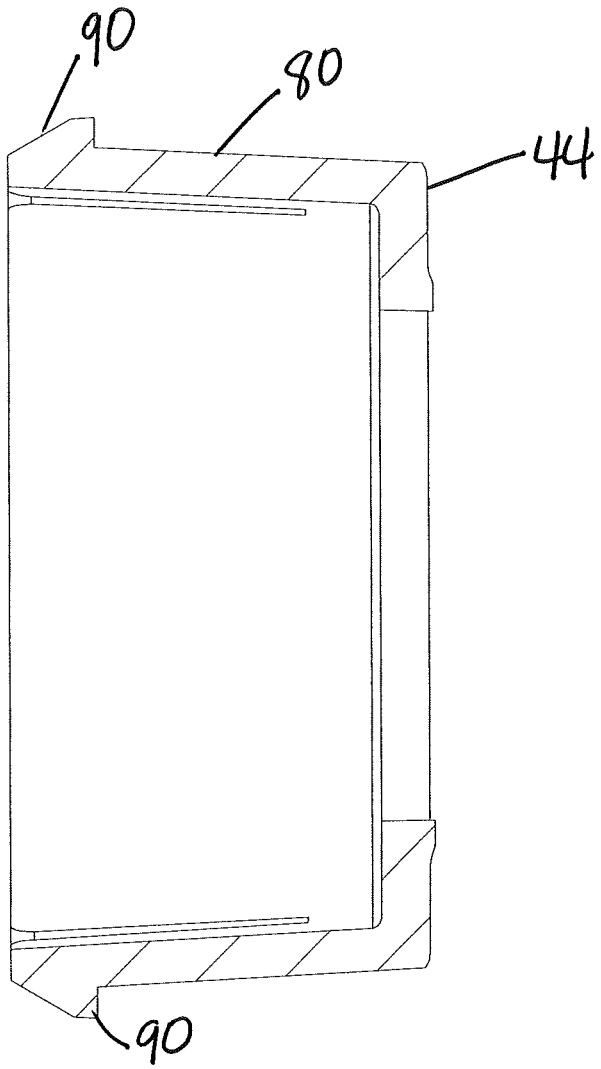
FIG. 21 is a sectional view taken along lines 21-21 of FIG. 20.
Figure 22:
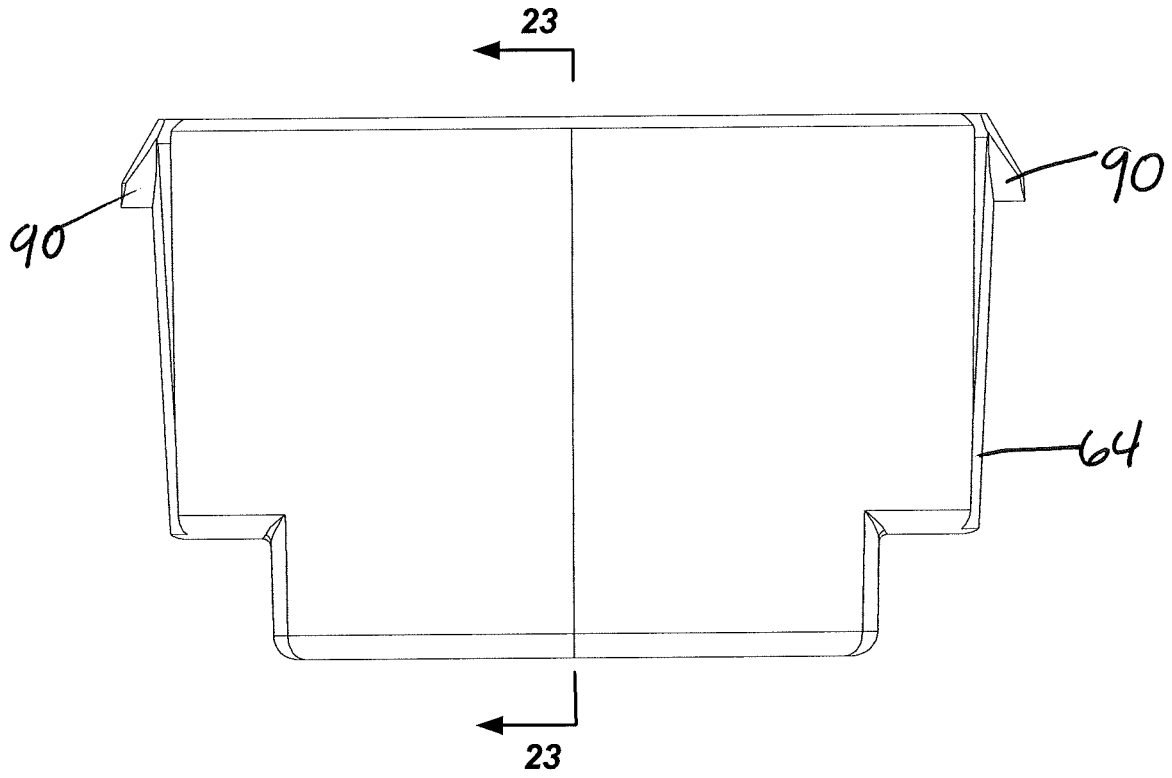
FIG. 22 is a view of an end cap.
Figure 23:
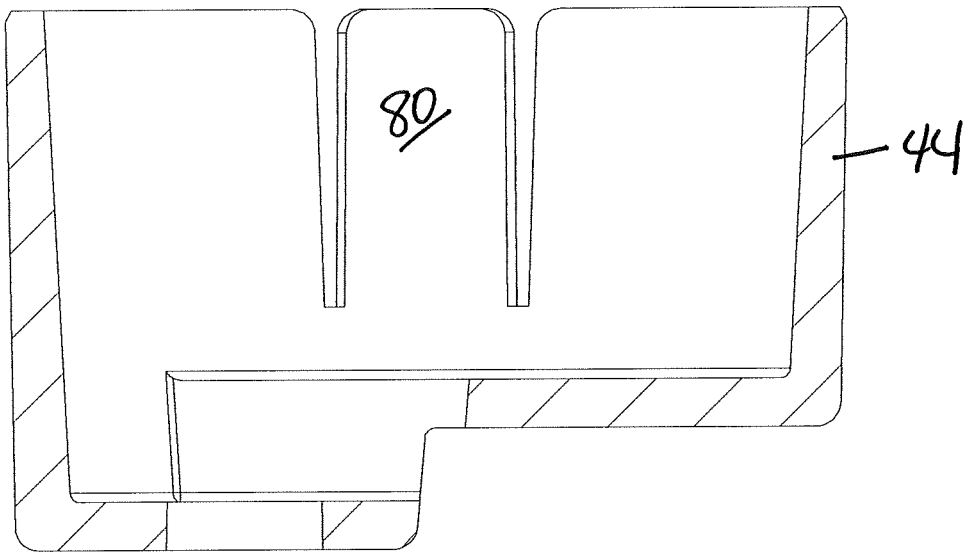
FIG. 23 is an interior sectional view taken along lines 23-23 of FIG. 22.
Figure 24:
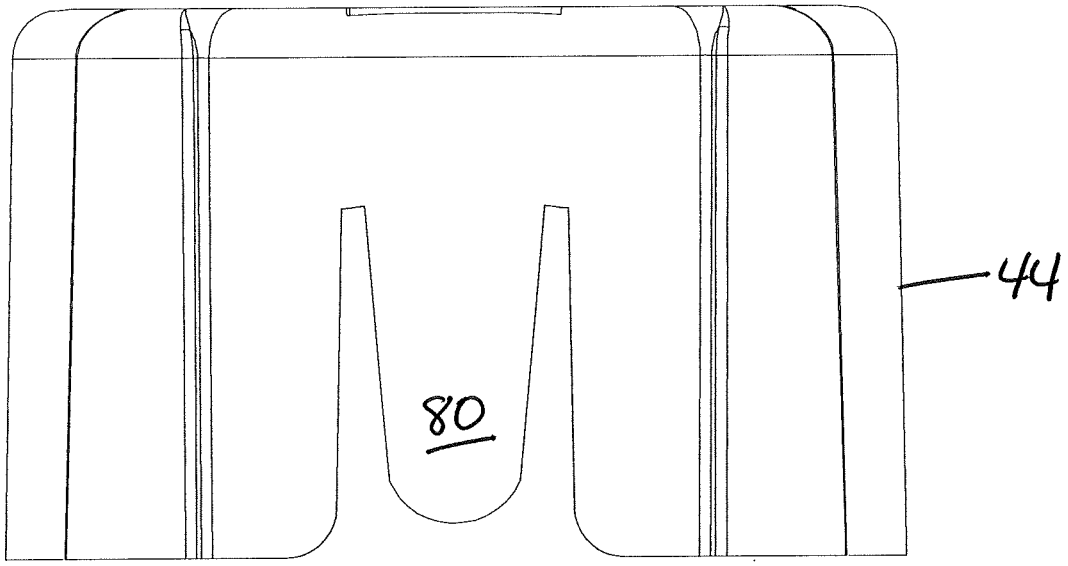
FIG. 24 is a plan view of the bottom end cap.
Figure 25:
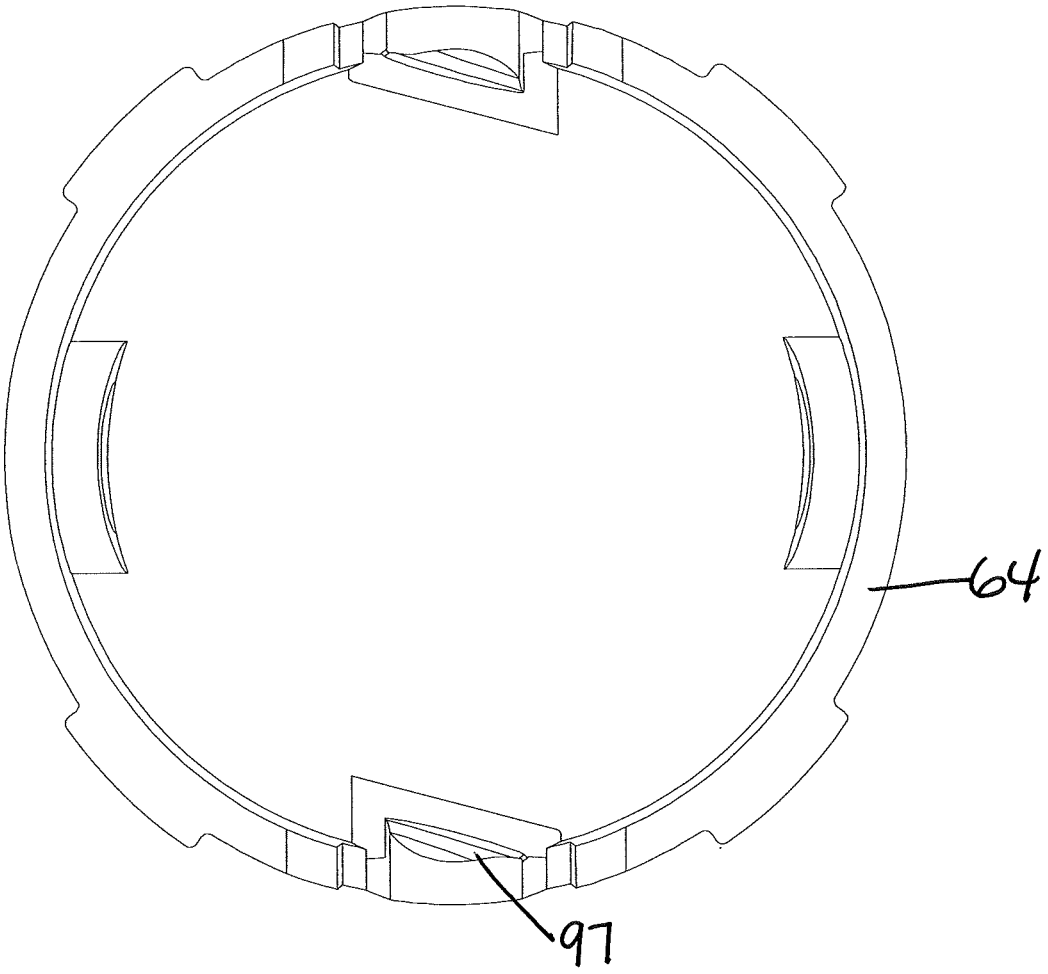
FIG. 25 is an interior view of the bottom end cap.
Figure 26:
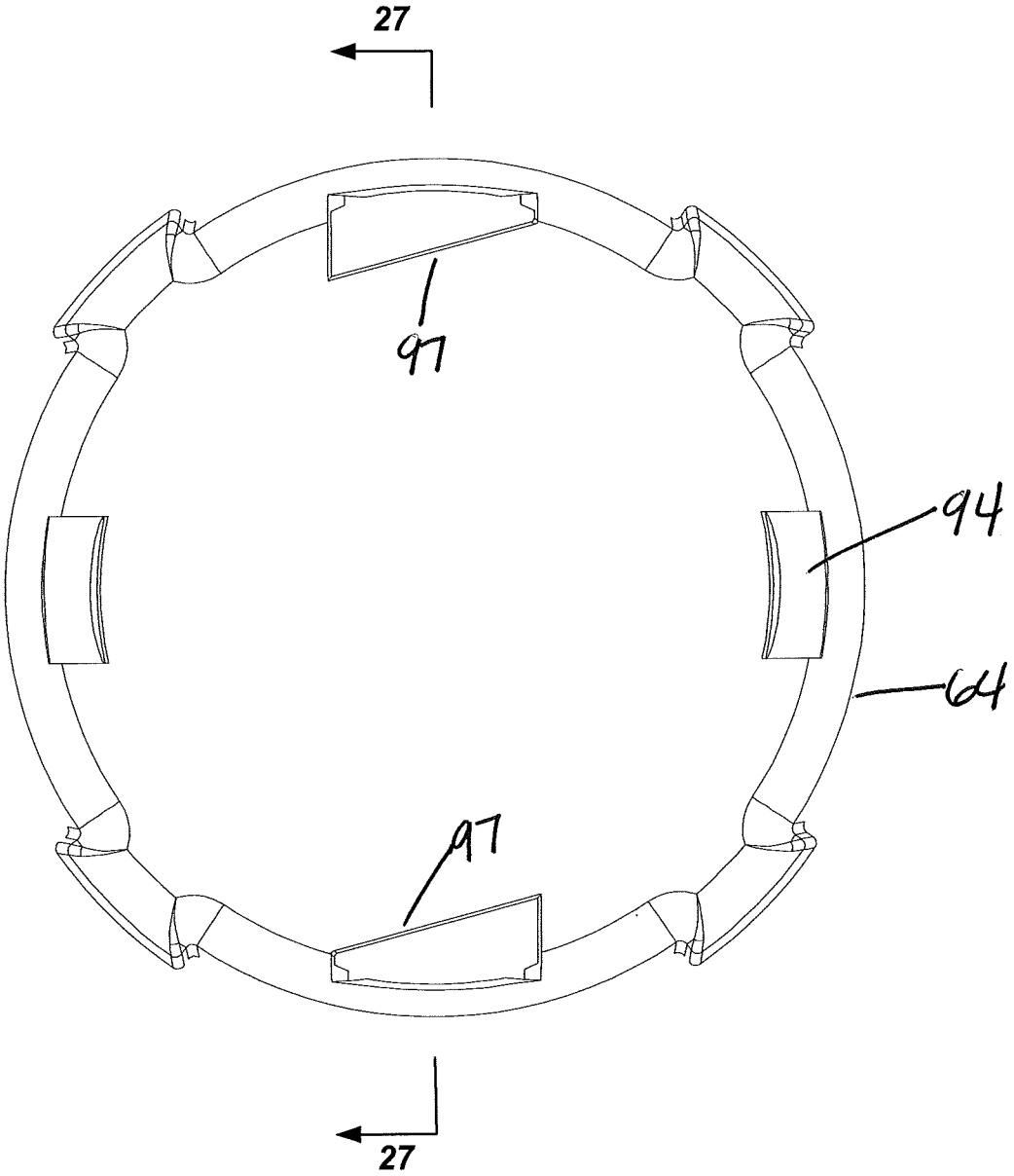
FIG. 26 is bottom interior view of the bottom end cap.
Figure 27:
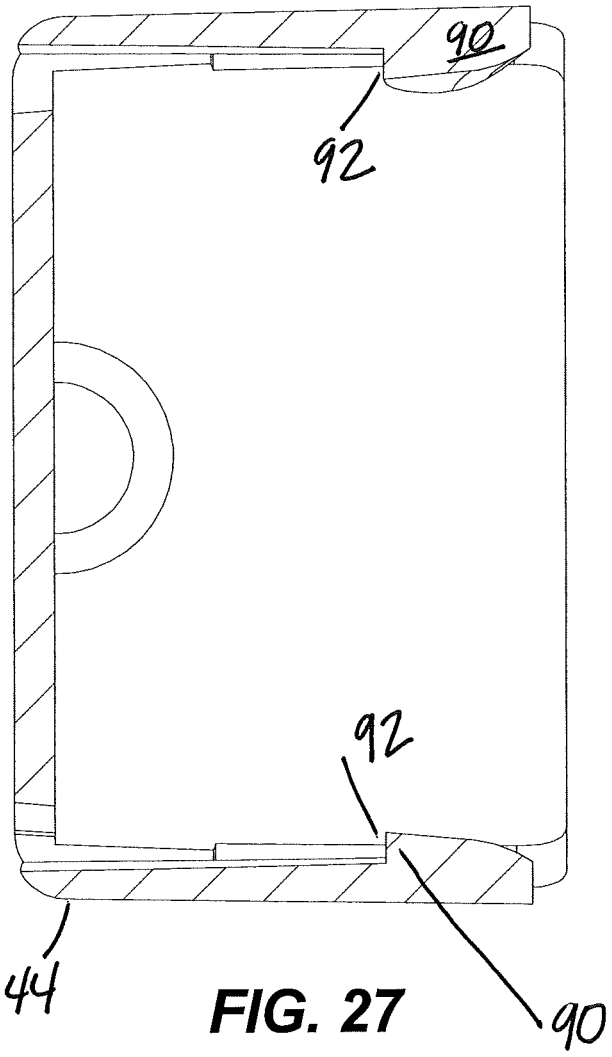
FIG. 27 is a view taken along lines 27-27 of FIG. 26.
Figure 28:
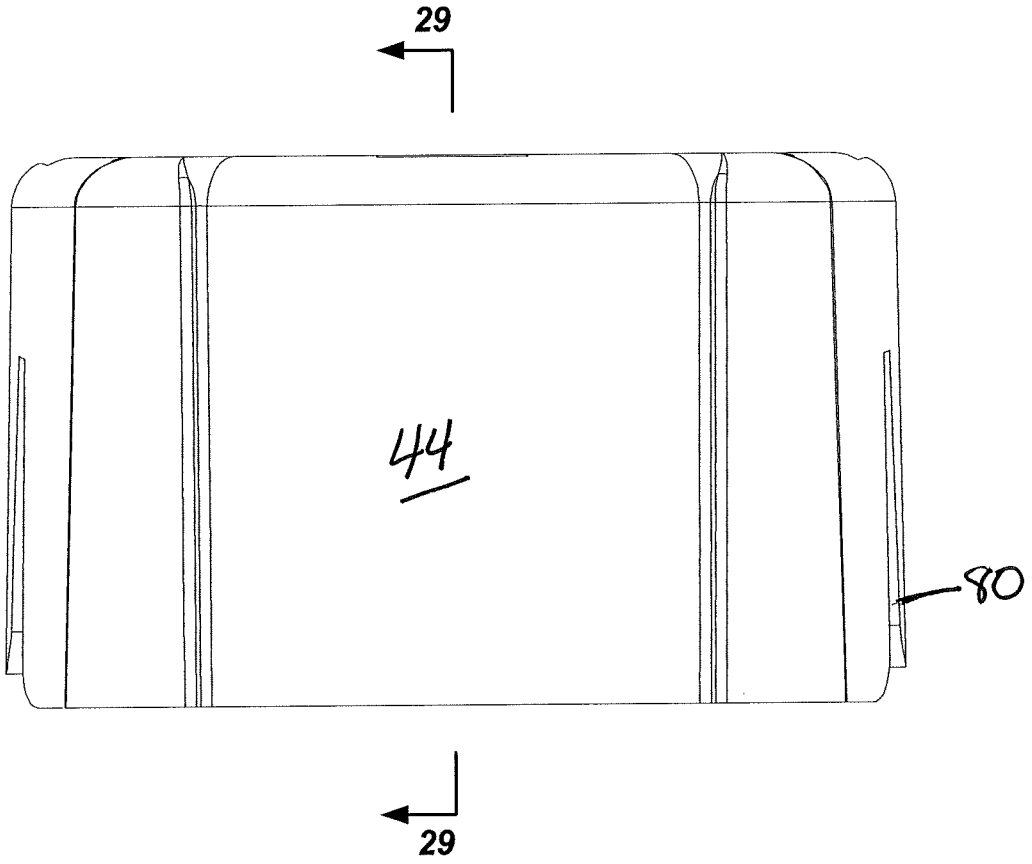
FIG. 28 is a side view of a bottom end cap.
Figure 29:
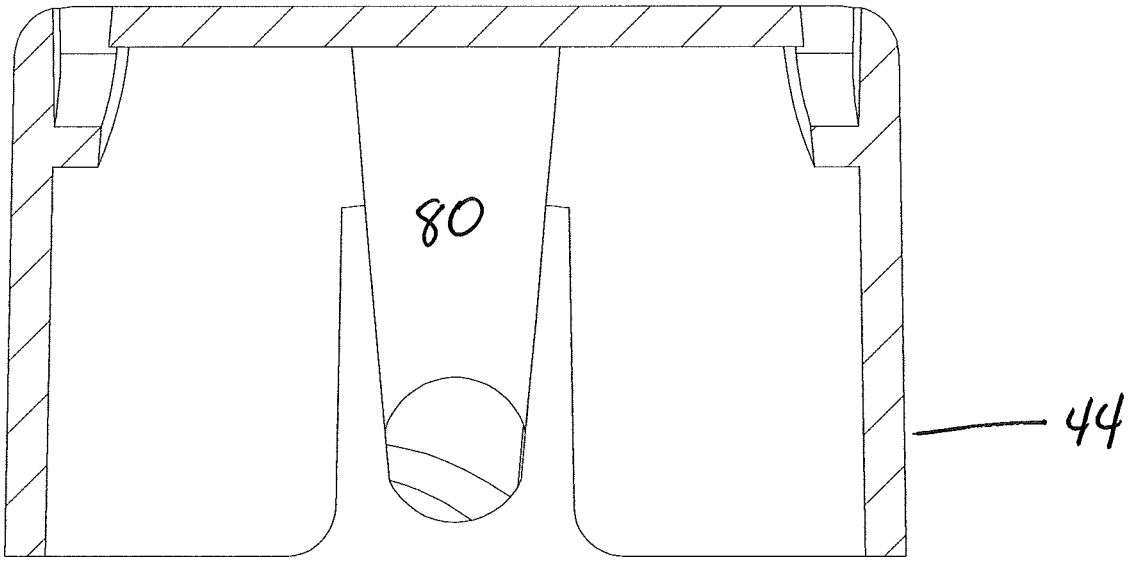
FIG. 29 is a section view taken along lines 29-29 of FIG. 28.

Both inner caps 52/64 have flexible bias finger 90 which engage a lip 92 (FIG. 3) in caps 30/44 to secure the two sections together. While not shown lip 92 has like placement in the upper cap as is shown in the lower cap. FIGS. 4-5 show a release port 94 which allows an insertion tool to release finger 80.

The ends web strap 22 may be affixed directly to the end cap as shown 55/58 or to an optional bracket 55/58 at its ends and the bracket riveted to inner cap 52 by rivet 36 and cap 64 by rivet 60. In the preferred embodiment, the strap 22 is directly affixed to the cap, eliminating the bracket. The web strap may be any length, but the weight of the strap must be considered in insuring that the top is buoyant despite the weight of the strap.

The brackets can be riveted to their mounts at 90 degree angles to each other to add greater space for the web.

The remaining FIGS. 4-9 disclosure features in greater detail.

Floatation 50 preferably comes from a closed-cell polyethylene cylinder. It resembles a swim noodle ordered to fit the diameter of the marker and cut to fill the floatation chamber. Such material can be found at Foamy Factory (https://www.foambymail.com/PE2C/polyethylene-cylinders.html). The foam may have a tendency to protrude through the top through aperture 51 next to the lanyard loop. A barrier plate 53 may be installed to prevent extrusion of the foam.

While the lower cap is preferably non-removable, the upper cap is removably, preferably by twisting. To accomplish this, the upper cap is designed to be twisted off. In FIGS. 4, 9, 11, 14, 16 and 19, flexible finger elements 80 have an inward projection 97 which is slanted/ramped in one rotational direction. That is to say, the thickness of the projection increases across the face of thereof. The ramp may also be in the direction which allows the cap to be pulled longitudinally away from the tube. This allows the projection to engage and lock in the tube apertures, but it allows the cap itself to be removed by twisting or counter-rotating against the tube. In effect, the cap is released by twisting in the direction which uses the distal ramped surface to extricate the projections from the apertures 72. Once the projections are lifted out of the apertures via the ramp, the cap is only held on the tub by friction, for example, by rotating the cap in a direction which moves the lowest part of the ramp in out of the aperture first. Inner caps 52/64 may also be designed this way for ease of removal in case different floats/weights are needed.

The inner caps 52/64 are molded to allow for the connection of the nylon strap. The upper one 52 preferably snaps into the top of the marker tube in a permanent fashion and forms the bottom of the buoyancy chamber. It also becomes the attachment point for the marker tube to the weighted section when the weighted section is deployed from the marker. This allows the marker tube to float above the sea floor providing greater visibility. The other inner cap is used to attach to the lower cap in a permanent fashion and forms the upper half of the weight chamber. It also becomes the attachment point for the weighted section or anchor when the anchor is deployed from the marker.

The tube 20 is preferably colored acrylic cut to form the body of the marker. It is drilled to provide attachment points for all the molded pieces. When deployed the tube functions as a highly visible underwater buoy. When not deployed the tube provides for the space to store the web 22 which may be a nylon strap.

The snap is plastic snap rivet 36/60 that secures the nylon strap 22 to the inner caps to form a secure connection from the weighted section to the floatation section.

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A vertical dive position marker comprising:

a housing having an inner peripheral wall and defining a space within said wall; a bottom end cap sized to be fitted to said housing and being replaceably removable therefrom, said bottom end cap having a negative buoyancy when apart from said housing, so that when released therefrom the housing will float with the bottom end cap removed;

said bottom end cap having a fixation point;

an elongated web strap member having first and second ends, said first end being attached to said fixation point and said second end being attached to said housing;

said web strap member being folded and fitted within said housing when said bottom end cap is fitted on said housing and extendable when said bottom end cap is separated from said housing and the housing is allowed to float upwardly;

said bottom end cap including a weight of sufficient mass that said marker has negative buoyancy when said bottom end cap is attached to the housing and said marker has a positive buoyancy when said bottom end cap is removed from the housing;

so that when said bottom end cap is separated from said housing, the housing will float upwardly, thereby extending the web strap vertically while the bottom end cap sinks.

2. The marker of claim 1 wherein said bottom end cap includes flexible fingers and wherein said housing includes a plurality of apertures positioned to engage said fingers when said bottom end cap is fitted to said housing.

3. The marker of claim 1, further including a first illumination element which is activated when said bottom end cap is separated from the housing.

4. The marker of claim 3 including a second illumination element attached to said housing.

5. The marker of claim 1, further including a first illumination element which is integral to said web strap member and provides points of illumination at least periodically along a portion of the length thereof.

6. The marker of claim 5, wherein said first illumination element includes a chemical illuminant which is activated when said web strap element is removed from the housing.

7. The marker of claim 5, wherein said first illumination element includes an electrical illuminating element which is activated when said web strap element is removed from the housing.

8. The marker of claim 1 wherein said bottom end cap is twistably removable from said housing.

9. A reusable vertical underwater location marker comprising:

a housing having an inner peripheral wall and defining a space within said wall and top and bottom ends;

a top end cap sized to be fitted to said housing at said first end and being replaceably removable therefrom; said top end cap including a top inner cap;

a bottom end cap sized to be fitted to said housing at said bottom end and having a bottom inner cap;

said top end cap including a float element so that said top end cap and housing have positive buoyancy when separated from said bottom end cap, so that when said bottom end cap is released from the housing, the housing and top end cap together float;

said housing and end caps together define an enclosure with overall positive buoyancy;

an elongated web strap member having first and second ends, said first end being attached to said top inner cap and said second end being attached to said bottom inner cap;

said web strap member being initially folded and fitted within said housing defined space when said top cap is fitted on said housing and said web strap being extendable when said top end cap is separated from said housing and allowed to float upwardly;

said bottom end cap including a weight of sufficient mass that said marker has negative buoyancy when said bottom end cap is attached to the housing;

so that when said bottom end cap is separated from said housing, said top end cap and housing will float upwardly, thereby extending the web strap vertically while the bottom end cap sinks.

10. The marker of claim 9 wherein said top inner cap surrounds at least in part, said float and engages with said top end cap to immobilize said float between said top end cap and said top inner cap.

11. The marker of claim 9 wherein said bottom inner cap surrounds at least in part, said weight and engages with said bottom end cap to immobilize said weight between said bottom end cap and said bottom inner cap.

12. The marker of claim 9 wherein said top end cap includes flexible fingers and wherein said housing includes an inner ridge positioned to engage said fingers when said top end cap is fitted to said housing, and further including a floatation element sized to be received within a spaced defined by the top inner cap and said top end cap when the two are brought together with the floatation element therein.

13. The marker of claim 12 wherein said floatation element is interchangeable to provide interchangeable levels of buoyancy as needed based on a weight of the marker.

14. The marker of claim 12 wherein said weight element is interchangeable to provide interchangeable levels of buoyancy as needed based on a weight of the marker.

15. The marker of claim 9 wherein said web strap member has first and second ends and wherein each end includes a flange, and wherein said flanges are attached to said top and bottom inner caps respectively.

16. The marker of claim 9 wherein said bottom end cap includes flexible finger elements having inward projections and wherein said housing includes apertures sized to receive said projections, and wherein said projections include a distal ramped surface which allows disengagement of the projection from the apertures by twisting the bottom end cap in a direction which moves the ramp against the aperture.

17. A method of constructing a dive position marker having a housing tube having first and second ends, first and second outer end caps, first and second inner end caps, a web strap element, first and second ends attachable to said tube ends, a weight element and a floatation element, comprising the steps of:

a. configuring the inner caps to fit into the outer cap thereby defining a confining space there between;

b. affixing a flotation element within the space defined by the attachment of said first outer end cap to said first inner end cap;

c. affixing a weight element within the space defined by the attachment of said second outer end cap to said second inner end cap;

d. selecting a weight element such that the housing with first and second outer caps has negative buoyancy and with said second end cap separated from the housing, the housing has a positive buoyancy;

e. affixing the first end of said strap element to said first end cap;

f. affixing the second end of the strap element to said second end cap;

g. folding the strap element so that it can fit entirely within said housing when said end caps are emplaced on the housing; and h. inserting said folded strap within said housing;

so that when the second end cap is removed from the housing, the second end cap will sink and the housing will float.

18. The method of claim 17 including:

a. selecting the weight element to have sufficient mass to insure that the housing will have negative buoyancy;

b. selecting the floatation element to have sufficient positive buoyancy to float the first end cap when separated from the housing with the strap element connected between the housing and first end cap; and c. configuring the second end cap to be removable by twisting locking elements out of locking position.

19. A reusable vertical underwater location marker comprising:

a housing having an inner peripheral wall and defining a space within said wall and top and bottom ends, the top end having a top end cap, the bottom end having a bottom end cap, said housing and end caps together define an enclosure;

said top end cap sized to be fitted to said housing at said top end and being replaceably removable therefrom;

said top end cap including a float element so that said top end cap and housing have positive buoyancy when separated from said bottom end cap;

said bottom end cap sized to be fitted to said housing at said bottom end, said bottom end cap including a weight of sufficient mass that said marker has negative buoyancy when said bottom end cap is attached to the housing;

so that when said bottom end cap is released from the housing, the housing and top end cap will together-float;

an elongated web strap member having first and second ends, said first end being attached to said top end cap and said second end being attached to said bottom end cap;

said web strap member being initially folded and fitted within said housing and said web strap being extendable when said bottom end cap is separated from said housing;

so that when said bottom end cap is separated from said housing, said top end cap and housing will float upwardly, thereby extending the web strap vertically while the bottom end cap sinks.

* * * * *